United States Patent [19]

Haack

[11] 4,299,629

[45] Nov. 10, 1981

[54] METAL POWDER MIXTURES, SINTERED ARTICLE PRODUCED THEREFROM AND PROCESS FOR PRODUCING SAME

[75] Inventor: Ernest E. Haack, Muskegon, Mich.

[73] Assignee: Goetze AG, Burscheid, Fed. Rep. of Germany

[21] Appl. No.: 44,408

[22] Filed: Jun. 1, 1979

[51] Int. Cl.[3] ..... B22F 1/00

[52] U.S. Cl. ..... 75/251; 75/171; 75/200

[58] Field of Search ..... 75/171, 200, 251

[56] References Cited

U.S. PATENT DOCUMENTS

| | | | |
|---|---|---|---|
| 3,607,250 | 9/1971 | English | 75/171 |
| 3,681,059 | 8/1972 | Shaw et al. | 75/171 |
| 3,689,257 | 9/1972 | Oda et al. | 75/200 |
| 3,838,981 | 10/1974 | Foley et al. | 75/171 |
| 3,950,165 | 4/1976 | Oda et al. | 75/200 |
| 4,123,266 | 10/1978 | Foley et al. | 75/244 |

*Primary Examiner*—Brooks H. Hunt

*Attorney, Agent, or Firm*—Spencer & Kaye

[57] ABSTRACT

A wear-, corrosion-, heat-, and abrasion-resistant sintered body is prepared from a metallic powder mixture of from about 95 to 99.5% of a base alloy powder and about 0.5 to 5% of an additive alloy powder, wherein the additive alloy has a melting point which is lower than the melting point of the base alloy such that when pressed and sintered at a temperature above the melting point of the additive alloy and below the melting point of the base alloy a sintered body is produced having a density of at least 95% of the theoretical density.

14 Claims, No Drawings

METAL POWDER MIXTURES, SINTERED ARTICLE PRODUCED THEREFROM AND PROCESS FOR PRODUCING SAME

BACKGROUND OF THE INVENTION

The present invention relates to highly densified sintered alloy bodies having at least 95%, and preferably almost 100% of theoretical density, and to a method for preparing such bodies. The invention relates, also, to highly wear, corrosion, heat and abrasion resistant sintered alloy bodies which are suitable for use as machine parts for internal combustion engines.

Machine parts for internal-combustion engines, such as, for example, valve seat inserts and piston rings, must exhibit, in addition to a high resistance to wear, a high resistance to corrosion and alternating thermal stresses. It is generally known that sintered materials based on nickel and cobalt alloys have desirable corrosion and heat resistance characteristics. However, the strength of such conventionally produced alloys is not sufficient for all applications. Furthermore, for certain applications, particularly for use in machine parts such as valve seat inserts for thermal-combustion engines which are subjected to high stresses, it is essential that the alloys exhibit a density of almost 100% of theoretical, in addition to exhibiting high strength and wear characteristics.

In this regard, it is known that the density of the sintered alloys is a function of grain size of the sinter powder, the pressure under which the powder is compacted during sintering, and the temperature and duration of the sintering operation. Accordingly, it is generally accepted that sintered bodies of relatively high density can be produced by utilizing high compaction pressure, high sintering temperature and long sintering duration. However, due to the considerably increased expenditures for apparatus and energy, such sintered bodies generally are prohibitively expensive. Moreover, even when expense is not considered to be a major factor, it has been found to be difficult if not impossible to achieve densities approaching 100% of theoretical merely by increasing the compaction pressure, sintering temperature and sintering duration.

In an effort to overcome the problem of achieving high density for sintered alloy bodies, various prior art techniques have been developed. For example, in German Pat. No. 975,195, it is shown that additions of up to 2.5% elemental boron to iron or iron alloy powders, results in the formation during sintering of low melting point compounds comprising the boron and iron or iron alloy powders, whereupon, at the sintering temperature, the boron compounds fill or infiltrate the cavities in the sintered body. Although the sintered bodies prepared in accordance with this German Patent exhibit a relatively high density, it is not possible to lower substantially either the sintering temperature or the sintering duration because the low melting point boron compounds must be formed during the sintering process.

Another approach for increasing the density of sintered alloy bodies is described in U.S. Pat. No. 3,950,165 to Oda et al, wherein an admixture of an iron powder with an alloy of iron-titanium is sintered at a temperature at which the powdered mixture is partially in the liquid phase during sintering. Similar liquid phase sintering techniques are disclosed in U.S. Pat. No. 3,890,145 to Hivert et al, U.S. Pat. No. 3,770,392 to Amra, and U.S. Pat. No. 3,689,257 to Oda et al.

However, these processes are deemed expensive and difficult to control in production due to the very confined compositional limits which must be maintained.

The Hivert et al patent relates to the sintering of very fine tungsten powder mixed in the cold with a metallic binder containing 65–90% nickel, 5–20% chromium and 5–15% phosphorus. The binder transforms to the liquid state at the sintering temperature. The Amra patent relates to sintered molybdenum based alloys having a crystalline structure which consists of a particulate phase of essentially molybdenum and a matrix phase of a copper and nickel solid solution. The Oda et al patent relates to sintered ferrous alloys in which iron-silicon alloy powders with more than 7% silicon, and the remainder iron are added to iron powders at a rate of 0.3–10% silicon.

In U.S. Pat. No. 3,471,343 to Koehler, a method of repressing and resintering is described which is intended to encourage densification. This technique, used in conjunction with specified powder blends, requires duplicate operations and additional tooling outlays with attendant high cost of production.

Accordingly, it is an object of the present invention to provide an alloy powder which can be densified without special energy expenditures to produce highly densified sintered bodies.

It is another object of the present invention to provide wear- and corrosion-resistant sintered bodies having a density of at least 95% and, preferably, at least 99% of theoretical density.

It is yet another object of the invention to prepare sintered alloy bodies of at least 95% and, preferably, almost 100% theoretical density, using compaction pressures, sintering temperatures and sintering durations which are lower than those used in prior art sintering processes such that the manufacture of the sintered bodies can be achieved economically.

According to the invention, these and other objects and advantages are accomplished by providing a metal powder mixture in which 0.5 to 5% of a low melting point metal powder or alloy powder is mixed with 95 to 99.5% of a base high alloy powder. As used in this specification and claims, all reference to % is meant to define % by weight. The mixed metal powder is then pressed in a suitable mold and sintered to form the desired high density product.

It has been found that even at low compacting pressures, for example, sufficient to compact the mixed metal powder to a green density of from about 6.8 to about 7.2 g/cm$^3$, and a low sintering temperature, for example, from about 1000° to about 1300° C., or at approximately the melting temperature of the low melting point additive, and with a relatively short sintering duration, for example, from about 20 to about 40 minutes, a sintered body is produced which has a high degree of densification and strength. Consequently, only low amounts of energy and minimum production equipment are required.

Nickel alloy powders are particularly suited for use in the production of highly densified valve seat inserts and accordingly, the preferred alloy powders contemplated for use in the present invention are alloys in which nickel is the major component, although other metals may be used as the base constituent. It is also preferred that the low melting metal or alloy powder be an alloy in which nickel is the main component. In a preferred embodiment, the low melting nickel base alloy is one which contains both boron and silicon, since it has been found that by using such low melting point nickel base materials it is possible to realize a particularly high degree of densification.

The added quantities of low melting material lie between 0.5 and 5%, since it has been found that the addition of more than 5% of the low melting point alloy results in the production of sintered bodies having a relatively lower strength and lower degree of densification such that the sintered bodies are unsuitable for use as valve seat inserts.

During the sintering, the low melting point nickel base alloy melts such that the resulting liquid phase reacts with the particles of the compacted body with eventual metallurgical solution in the parent material, thus producing an article, such as a valve seat insert with the desired high density. Compaction pressure, sintering temperature and sintering duration can then be kept substantially lower than in prior art sintering methods so that the manufacture of such sintered bodies becomes substantially more economical.

The preferred alloys which are used in accordance with the present invention in amounts of from 95 to 99.5%, may include:

| | |
|---|---|
| carbon | a maximum of 1.25% |
| cobalt | 9 to 11% |
| tungsten | 13 to 16% |
| chromium | 27 to 31% |
| silicon | a maximum of 1% |
| iron | a maximum of 8% |
| nickel and incidental impurities | the balance. |

The low melting point additive alloys which are used preferably include:

| | |
|---|---|
| carbon | a maximum of 1% |
| chromium | 5 to 18% |
| boron | .1 to 4%, preferably 1 to 4% |
| silicon | .1 to 6%, preferably 3 to 6% |
| iron | a maximum of 6% |
| nickel and impurities | the balance. |

The particle size of the nickel base alloy powder and the low melting alloy powder is not critical, and particle sizes conventionally, employed in processes of this type may be employed. For example, the particle size of the nickel base alloy may range up to 150 microns. The particle size of the low melting point alloy may also range up to 150 microns.

The invention will be understood more fully when veiwed in conjunction with the following examples.

EXAMPLE 1

A metal powder mixture was prepared by mixing 97 parts, by weight, of a nickel base alloy consisting essentially of 0.8% carbon, 10% cobalt, 14.5% tungsten, 29% chromium, 0.8% silicon, 7% iron and the remainder nickel with 3 parts by weight, of a low melting point nickel alloy consisting essentially of 0.7% carbon, 14% chromium, 3% boron, 4.5% silicon, 4.5% iron, and the remainder nickel. Thereafter the metal powder mixture was pressed to a green density of 7.2 g/cm$^3$ in a mold designed for the production of valve seat inserts, and was then sintered at 1270° C. for 40 minutes. The resulting valve seat insert had a density of 99% for theoretical.

EXAMPLE 2

A sinter powder was prepared by mixing 99 parts by weight, of the base alloy of Example 1 with 1 part, by weight, of a low melting point additive alloy consisting essentially of 0.05% carbon, 7% chromium, 3.1% boron, 4.5% silicon, 3% iron, and the remainder nickel. Thereafter a valve seat insert was pressed from the powder mixture to a green density of 7.2 g/cm$^3$ and sintered at a temperature of 1270° C. for a duration of 24 minutes.

The resulting valve seat insert had a density of 99% of theoretical density.

Both of the valve seat inserts sintered according to Examples 1 and 2 proved to be corrosion resistant and highly breakage resistant under alternating thermal stresses.

Although the present invention has been described in conjunction with preferred embodiments, it is to be understood that modifications and variations may be resorted to without departing from the spirit and scope of the invention, as those skilled in the art readily will understand. Such modifications and variations are considered to be within the purview and scope of the present invention as defined by the appended claims.

I claim:

1. A metallic powder mixture for the production of highly densified sintered bodies which exhibit high resistance to wear, corrosion and alternating thermal stresses, which comprises 95 to 99.5% of a base alloy powder and 0.5 to 5% of an additive alloy powder comprising a nickel base alloy which contains from 0.1 to 4% boron and 0.1 to 6% silicon, said additive alloy having a melting point which is lower than the melting point of said base alloy such that when pressed and sintered at a temperature above the melting temperature of said additive alloy and below the melting temperature of said base alloy for about 20 to about 40 minutes, a sintered body is produced having a density of at least 95% of the theoretical density.

2. A metallic powder mixture as set forth in claim 1, wherein said additive alloy comprises:

| | |
|---|---|
| carbon | 1% maximum |
| chromium | 5–18% |
| boron | .1–4% |
| silicon | .1–6% |
| iron | 6% maximum |
| nickel and incidental impurities | the balance. |

3. A metallic powder mixture in accordance with claim 1, wherein said base alloy comprises nickel as the major component.

4. A metallic powder mixture in accordance with claim 2, wherein said base alloy comprises nickel as the major component.

5. A metallic powder mixture in accordance with claim 1, wherein said base alloy comprises:

| | |
|---|---|
| carbon | 1.25% maximum |
| cobalt | 9–11% |
| chromium | 27–31% |
| tungsten | 13–16% |
| iron | 8% maximum |
| silicon | 1% maximum |

-continued

| | |
|---|---|
| nickel and incidental impurites | the balance. |

6. A metallic powder mixture in accordance with claim 2, wherein said base alloy comprises:

| | |
|---|---|
| carbon | 1.25% maximum |
| cobalt | 9–11% |
| chromium | 27–31% |
| tungsten | 13–16% |
| iron | 8% maximum |
| silicon | 1% maximum |
| nickel and incidental impurites | the balance. |

7. A metal powder mixture for the production of sintered bodies having a density of at least 95% of theoretical density, wherein the sintered bodies exhibit high corrosion-, wear-, heat-, and abrasion-resistance, which comprises from about 95 to 99.5% of a base powder alloy consisting essentially of up to 1.25% carbon, from about 9–11% cobalt, from about 13–16% tungsten, from about 27–31% chormium, up to 1% silicon, up to 8% iron, and the balance nickel and impurities, and from about 0.5 to 5% of a low melting point additive alloy consisting essentially of up to 1% carbon, up to 6% iron, from about 0.1–6% silicon, from about 0.1–4% boron, from about 5–18% chromium, and the balance nickel and impurities.

8. A sintered article prepared from the metal powder mixture of claim 1.

9. A sintered article prepared from the metal powder mixture of claim 1.

10. A sintered article prepared from the metal powder mixture of claim 2.

11. A sintered article prepared from the metal powder mixture of claim 5.

12. A sintered article prepared from the metal powder mixture of claim 6.

13. A sintered article prepared from the metal powder mixture of claim 8.

14. A process for preparing sintered articles of high density comprising: mixing from about 95 to 99.5% of a base alloy powder consisting essentially of up to 1.25% carbon, from about 9–11% cobalt, from about 13–16% tungsten, from about 27–31% chromium, up to 1% silicon, up to 8% iron, and the balance nickel and impurities, with from about 0.5 to 5% of a low melting additive alloy powder consisting essentially of up to 1% carbon, up to 6% iron, from about 0.1–6% silicon, from about 0.1–4% boron, from about 5–18% chromium, and the balance nickel and impurities; compacting said mixture to a green density of from about 6.8 to about 7.2 g/cm$^3$; and sintering said mixture at a temperature of from about 1000° to about 1300° C., for a duration of from 20 to about 40 minutes.

* * * * *